United States Patent [19]

Perrin

[11] Patent Number: 4,640,679

[45] Date of Patent: Feb. 3, 1987

[54] FLAME SHIELD FOR CIGARETTE LIGHTER AND CIGARETTE LIGHTER INCLUDING SAID FLAME SHIELD

[76] Inventor: Denis Perrin, 1315 Avenue "P", Ottawa, Ontario, Canada, K1G 0B4

[21] Appl. No.: 661,041

[22] Filed: Oct. 15, 1984

[51] Int. Cl.[4] ..... F23Q 25/00

[52] U.S. Cl. ..... 431/146; 431/310

[58] Field of Search ..... 431/144, 146, 151, 254, 431/276, 277, 310

[56] References Cited

U.S. PATENT DOCUMENTS

| | | | |
|---|---|---|---|
| 1,720,460 | 7/1929 | Ament | 431/356 |
| 2,505,047 | 4/1950 | Horning | 431/144 |
| 3,679,346 | 7/1972 | Lambert | 431/354 |
| 4,531,906 | 7/1985 | Mizukami | 431/146 |

*Primary Examiner*—Carroll B. Dority, Jr.

*Attorney, Agent, or Firm*—Martin J. Marcus

[57] ABSTRACT

An improvement is provided in a disposable lighter having a fuel receptacle, a pyrophoric sparking wheel lighting mechanism mounted on the top edge thereof, and a finger-actuated fuel-control valve adjacent the sparking wheel. The improvement is provided by a windshield of similar cross-section to that of the receptacle and slidably retained between upper and lower stop members on the receptacle, the windshield comprising two solid side walls, a solid back wall, an open top and an open front wall the solid side walls having a thumb-access cut-away portion, the open front wall having a cigarette-access opening above the cut-away portion of the side walls, the windshield being between about 50% and about 100% and preferably about 100% of the height of the receptacle. This provides a screen to enable the lighter to be lit even in strong winds.

9 Claims, 15 Drawing Figures

FLAME SHIELD FOR CIGARETTE LIGHTER AND CIGARETTE LIGHTER INCLUDING SAID FLAME SHIELD

BACKGROUND OF THE INVENTION (i) Field of the Invention

This invention relates to cigarette lighters and more particularly to improvements in such lighters which include a device to be used as a shield for the flame to enable the lighter to be lit even in a strong wind.

(ii) Description of the Prior Art

There are many instances where it is difficult to light such a cigarette lighter because of wind conditions. A problem which previous proposed solutions have not adequately addressed is that of effectively shielding the flame from the wind while allowing easy access of the cigarette to the so-shielded flame.

Many solutions have been proposed but none are completely satisfactory. Thus Canadian Pat. No. 286,802 issued Jan. 29, 1929 to M. Perrera provided a simple cylindrical sheath movably and adjustably received within an annular chamber of the lighter.

Canadian Pat. No. 287,265 issued Feb. 19, 1929 to E. F. Clark provided wind break having side walls and an end wall enclosing the flame elements on three sides and a wind break wall pivotted on the end wall to shield the open top of the enclosure.

Canadian Pat. No. 311,040 issued May 5, 1931 to L. V. Aronson provided a U-shaped windshield member upstanding from the top of the lighter with an arm extending along the walls to shield the wick therebetween. A side portion of the shield was cut away to permit access of a cigarette from the side of the lighter when the lighter was held in a horizontal position.

Canadian Pat. No. 354,896 issued Dec. 24, 1935 to H. S. Silberknopf provided a wind-breaking guard sleeve slidable to open and close the wick cap, with a spring to bias the wind-breaking guard sleeve to close the lighter automatically.

Canadian Pat. No. 491,907 issued Apr. 7, 1953 to W. I. Nissen provided a windshield surrounding the burner opening which was slidable, in a passageway, between a burner-opening exposing position and a burner-opening shielding position, and resilient means to urge the face of the windshield into contact with the passageway.

U.S. Pat. No. 1,720,460 issued July 9, 1929 to L. C. Ament provided a windshield having rear wall, side walls and an open top, and hinged arms to embrace the lighter to clamp the shield to the lighter.

SUMMARY OF THE INVENTION (i) Aims of the Invention

In spite of these prior old patents, there is still a need for the provision of a windshield for a cigarette lighter which will allow ready access of the cigarette to the flame while effectively shielding the flame.

Another object of this invention is to provide such a cigarette lighter in the form of a disposable lighter, with a windshield that may be either permanently, but slidably, mounted with respect thereto or removably mounted with respect thereto.

(ii) Statements of Invention

By this invention, an improvement is provided in a disposable lighter having a fuel receptacle, a pyrophoric sparking wheel lighting mechanism mounted on the top edge thereof, and a finger-actuated fuel-control valve adjacent the sparking wheel, the improvement comprising a windshield of similar cross-section to that of the receptacle and slidably retained on the receptacle, the windshield comprising two solid side walls, a solid back wall, an open top and an open wall having a lower peripheral ring joining two mutually opposed solid side walls, the solid side walls having a cut-away portion to allow unhindered access by a thumb of a user to the sparking wheel lighting mechanism having a cigarette-access opening above the cut-away portion of the side walls, the windshield being slidable along the outside of the receptacle from a lower position where the bottom periphery of the windshield abuts a lower cap on the receptacle to an upper position where the upper edge of the lower receptacle ring abuts, the windshield being between about 50% and about 100%, and preferably about 100% of the height of the receptacle.

This invention also provides for a windshield for a conventional disposable lighter having a fuel receptacle, a pyrophoric sparking wheel lighting mechanism mounted on the top edge thereof, and a finger-actuated fuel-control valve adjacent the sparking wheel, the windshield being of similar cross-section to that of the receptacle of the lighter with which it is adapted to be used and being adapted to be slidably retained on the receptacle, the windshield comprising two solid side walls, a solid back wall, an open top and an open front wall having a lower peripheral ring joining two mutually opposed solid side walls, the side walls having a cut-away portion to allow unhindered acess by a thumb of a user to the sparking wheel lighting mechanism having a cigarette-access opening adapted to be situated above the cut-away portion of the side walls, the windshield being slidable along the outside of the receptacle from a lower position where the bottom periphery of the windshield abuts a lower cap on the receptacle to an upper position where the upper edge of the lower peripheral ring abuts an upper stop member on the receptacle, the windshield being between about 50% and about 100%, and preferably about 100% of the height of the receptacle of the disposable lighter it is adapted to be used with.

(iii) Other Features of the Invention

By one feature thereof, the open front wall is provided with a pair of inwardly directed partial front walls, so that the opening in the open front wall is narrower than the width of the receptacle By another feature of the invention, the open front wall is provided with an upper, rigidifying ring.

By yet a further feature thereof, the windshield is made of anodized aluminum.

BRIEF DESCRIPTION OF THE DRAWINGS

In the accompanying drawings.

DESCRIPTION OF PREFERRED EMBODIMENTS (i) Description of the First Embodiment in FIGS. 1–5

Figure 2:
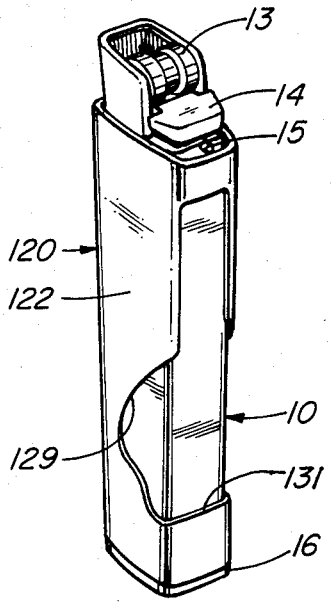
FIG. 2 is a perspective view of the lighter of the first embodiment of this invention with its windshield in its fully extracted position.
Figure 1:
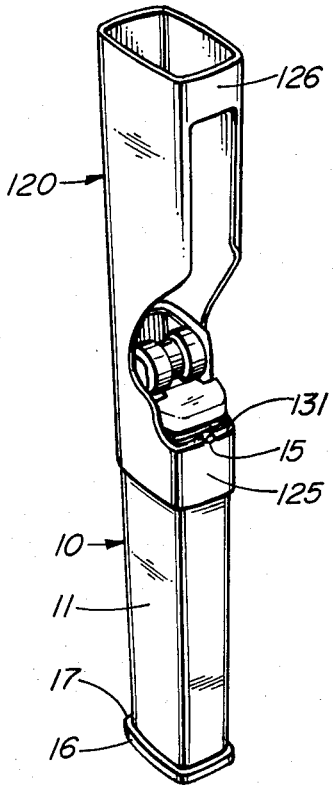
FIG. 1 is a perspective view of the lighter of a first embodiment of this invention with its windshield in its fully extended position.
Figure 5:
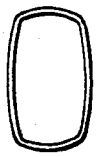
FIG. 5 is a top plan view of the windshield of FIG. 3.
Figure 4:
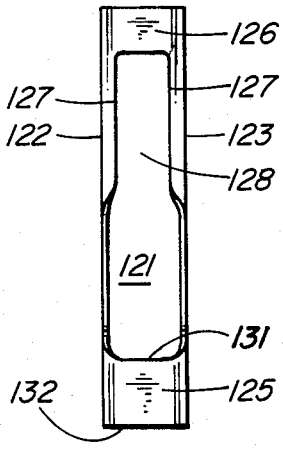
FIG. 4 is a front elevational view of the windshield of FIG. 3.
Figure 3:
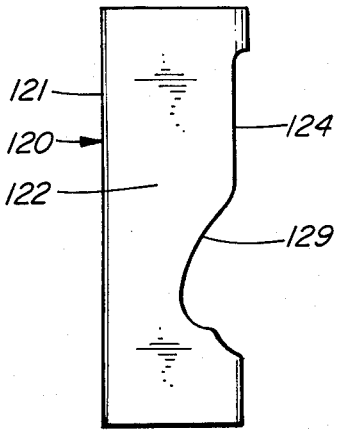
FIG. 3 is a side elevational view of the first embodiment of a windshield for use with the lighter of FIGS. 1 and 2.

As seen in FIGS. 1 and 2, the lighter is a conventional disposable lighter having a body 10 provided with a fuel receptacle 11, a pyrophoric sparking wheel 13 and a finger-actuated fuel-control valve 14 adjacent the sparking wheel 13.

The windshield, designated generally as 120 is slidable along the body 10 from a fully extended position (shown in FIG. 1) to a fully retracted position, (shown in FIG. 2).

The windshield 120 is of the same cross-sectional area as the body 10 and is in frictional contact therewith to be slidable thereon. The windshield 120 includes a rear wall 121, a pair of side walls 122, 123 and a front wall 124 constituted by a lower ring 125, an upper ring 126 and a pair of partial walls 127 extending downwardly from the upper ring 126. This provides a cigarette access opening 128. Side walls 122, 123 are each provided with a similar cut-away portion 129 to allow thumb actuation of the sparking wheel 13 and valve 14.

Preferably, the body 10 is provided with an upper stop pin 15 abuttable with the upper edge 131 of lower ring 125 and lower sealing cap 16 provided with an enlarged rim 17 abuttable with the lower edge 132 of lower ring 125.

(ii) Description of the Second Embodiment in FIGS. 6–10

Figure 7:
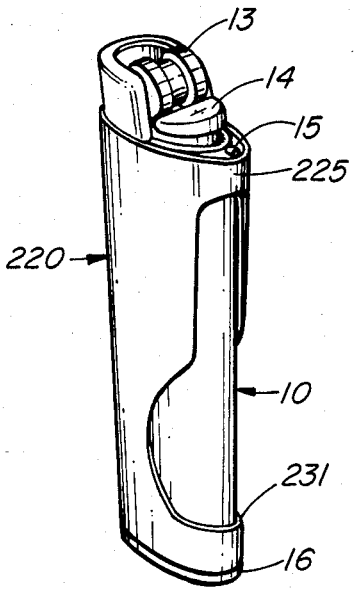
FIG. 7 is a perspective view of the lighter of the second embodiment of this invention with its windshield in its fully retracted position.
Figure 6:
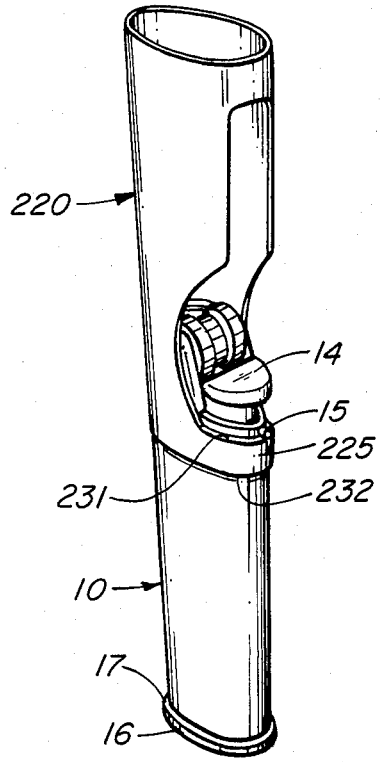
FIG. 6 is a perspective view of the lighter of a second embodiment of this invention with its windshield in its fully extended position.
Figure 10:
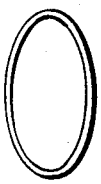
FIG. 10 is a top plan view of the windshield of FIG. 8.
Figure 9:
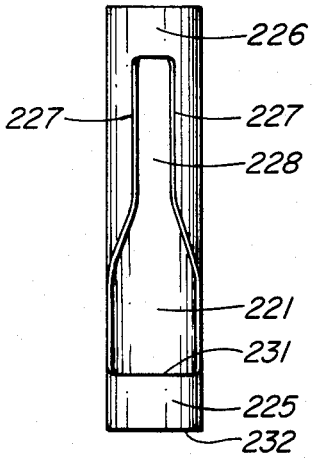
FIG. 9 is a front elevational view of the windshield of FIG. 7.
Figure 8:
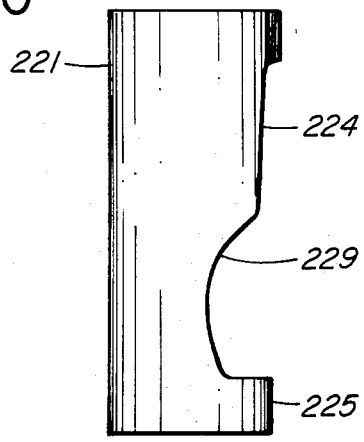
FIG. 8 is a side elevational view of the second embodiment of a windshield for use with the lighter of FIGS. 6 and 7.

As seen in FIGS. 6 and 7, the lighter is a conventional disposable lighter having a body 10 provided with a fuel receptacle 11, a pyrophoric sparking wheel 13, and a finger-actuated fuel-control valve 14 adjacent the sparking wheel 13.

The windshield, designated generally as 220 is slidable along the body 10 from a fully extended position (shown in FIG. 6) to a fully retracted position (shown in FIG. 7).

The windshield 220 is of the same cross-sectional area as the body 10 and is in frictional contact therewith to be slidable thereon. The windshield 220 includes a rear wall 221, a pair of side walls 222, 223 and a front wall 224 constituted by a lower ring 225, an upper ring 226 and a pair of partial walls 227 extending downwardly from the upper ring 226. This provides a cigarette access opening 228.

Side walls 222, 223 are each provided with a similar cut-away portion 229 to allow thumb actuation of the sparking wheel 13 and valve 14.

Preferably, the body 10 is provided with an upper stop pin 15 abuttable with the upper edge 231 of lower ring 225 and a lower sealing cap 16 provided with an enlarged rim 17 abuttable with the lower edge 232 of lower ring 225.

(iii) Description of the Third Embodiment in FIGS. 11–15

Figure 12:
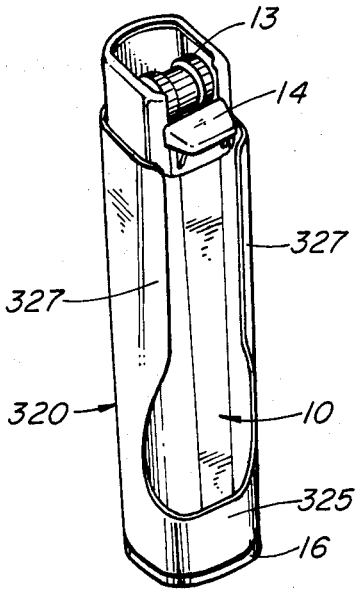
FIG. 12 is a perspective view of the lighter of the third embodiment of this invention with its windshield in its fully retracted position.
Figure 11:
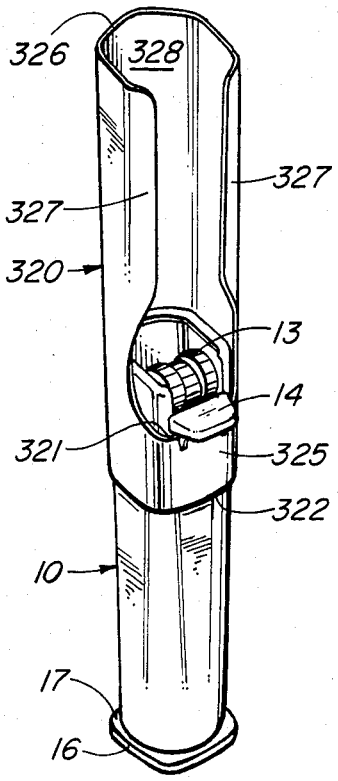
FIG. 11 is a perspective view of the lighter of a third embodiment of this invention with its windshield in its fully extended position.
Figure 15:
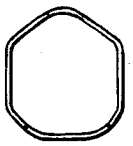
FIG. 15 is a top plan view of the windshield of FIG. 13.
Figure 13:
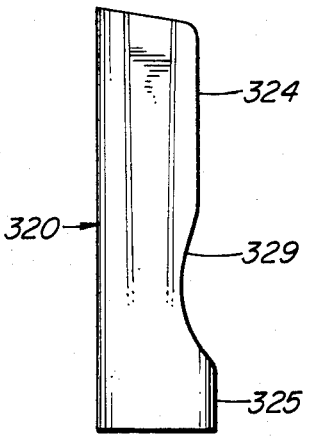
FIG. 13 is a side elevational view of the third embodiment of a windshield for use with the lighter of FIGS. 9 and 10.
Figure 14:
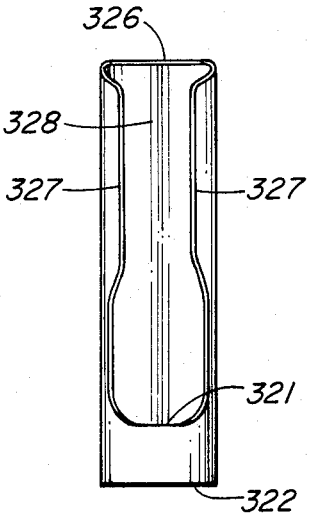
FIG. 14 is a front elevational view of the windshield of FIG. 11.

As seen in FIGS. 11 and 12, the lighter is a conventional disposable lighter having a body 10 provided with a fuel receptacle 11, a pyrophoric sparking wheel 13, and a finger-actuated fuel-control valve 14 adjacent the sparking wheel 13.

The windshield 320 is slidable along the body 10 from a fully extended position (shown in FIG. 11) to a fully retracted position (shown in FIG. 12).

The windshield 320 is of the same cross-sectional area as the body 10 and is in frictional contact therewith to be slidable thereon. The windshield 320 includes a rear wall 321, a pair of side walls 322, 323 and a front wall 324 constituted by a lower ring 325, an upper forwardly sloping edge 326, a pair of side walls 322, 323, and a front wall 324 constituted by a pair of partial walls 327 extending downwardly from the upper edge 326. This provides a cigarette access opening 328.

Side walls 322, 323 are each provided with a similar cut-away portion 329 to allow thumb actuation of the sparking wheel 13 and valve 14.

Preferably, the body 10 is provided with an upper stop pin 15 abuttable with the upper edge 321 of lower ring 325 and a lower sealing cap 16 provided with an enlarged rim 17 abuttable with the lower edge 332 of lower ring 325.

OPERATION OF THE PREFERRED EMBODIMENTS

In use, the windshield 120, 220 or 320 is raised to protect the spark wheel area from any wind, and the lighter ignited in the usual manner. It has been found that the lighter ignites every time due to the novel structure of the windshield, i.e. that it is from 50% to 100% of the height of the lighter body 10. The windshield 120, 220 or 320 is made of any suitable material, e.g. plastics. However, it preferably is made of anodized aluminum to allow it to be made of various colours.

SUMMARY

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. In a disposable lighter having a fuel receptacle, a pyrophoric sparking wheel lighting mechanism mounted on the top edge thereof, and a finger-actuated fuel control valve adjacent said sparking wheel, the improvement comprising: a windshield of similar cross-section to that of said receptacle and slidably retained on said receptacle, said windshield comprising two solid side walls and a solid back wall, an open top and an open front wall having a lower peripheral ring joining two mutually opposed solid side walls, said solid side walls having a cut-away portion to allow unhindered access by a thumb of a user to said sparking wheel lighting mechanism, said open front wall having a cigarette-access opening above said cut-away portion of said side walls, said windshield being slidable along the outside of said receptacle from a lower position where the bottom periphery of said windshield abuts a lower cap on said receptacle to an upper position where the upper edge of said lower peripheral ring abuts an upper stop member on said receptacle said windshield being between about 50% and about 100% of the height of the receptacle.

2. The disposable lighter of claim 1 wherein said windshield is about 100% of the height of said receptacle.

3. The disposable lighter of claim 1 wherein said windshield is made of anodized aluminum.

4. A windshield for a disposable lighter having a fuel receptacle, a pyrophoric sparking wheel lighting mechanism mounted on the top edge thereof, and a finger-actuated fuel-control valve adjacent said sparking wheel, said windshield being of similar cross-section to that of said receptacle of said lighter with which it is adapted to be used, and adapted to be slidably retained on said receptacle, said windshield comprising two mutually opposed solid side walls, a solid back wall, an open top, and an open front wall having a lower peripheral ring joining said two mutually opposed solid side walls, said solid side walls having a cut-away portion to allow unhindered access by a thumb of a user to said sparking wheel lighting mechanism, said open front wall having a cigarette-access opening adapted to be disposed above said cut-away portion of said side walls, said windshield being adapted to be slidable along the outside of said receptacle from a lower position where the bottom periphery of said windshield abuts a lower cap on said receptacle to an upper position where the upper edge of said lower peripheral ring abuts an upper stop member on said receptacle, said windshield being between 50% and 100% of the height of said receptacle of said lighter with which it is adapted to be used.

5. The windshield of claim 4 made of anodized aluminum.

6. The disposable lighter of claim 1 wherein said open front wall comprises a pair of opposed partial front walls forming an opening that is narrower than the thickness of said receptacle.

7. The disposable lighter of claim 1 wherein said open front wall is provided with an upper rigidifying ring.

8. The windshield of claim 4 wherein said open front wall comprises a pair of opposed partial front walls forming an opening narrower than the thickness of said receptacle.

9. The windshield of claim 4 wherein said open front wall is provided with an upper rigidifying ring.

* * * * *